US009673569B2

(12) United States Patent
Zhang

(10) Patent No.: US 9,673,569 B2
(45) Date of Patent: Jun. 6, 2017

(54) ELECTRICAL CONNECTOR WITH CENTRAL GROUNDING PLATE

(71) Applicant: Molex, LLC, Lisle, IL (US)

(72) Inventor: Xue-Hai Zhang, Xuzhou (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/988,811

(22) Filed: Jan. 6, 2016

(65) Prior Publication Data

US 2016/0197443 A1 Jul. 7, 2016

(30) Foreign Application Priority Data

Jan. 6, 2015 (CN) ..... 2015 2 0007911 U

(51) Int. Cl.

| | |
|---|---|
| ***H01R 13/6585*** | (2011.01) |
| ***H01R 12/71*** | (2011.01) |
| *H01R 24/60* | (2011.01) |
| *H01R 107/00* | (2006.01) |

(52) U.S. Cl.

CPC ..... *H01R 13/6585* (2013.01); *H01R 12/716* (2013.01); *H01R 24/60* (2013.01); *H01R 2107/00* (2013.01)

(58) Field of Classification Search

CPC ..... H01R 24/78

USPC ..... 439/607.08–607.11, 607.4, 607.35

See application file for complete search history.

(56) References Cited

U.S. PATENT DOCUMENTS

| | | | | |
|---|---|---|---|---|
| 4,687,267 | A * | 8/1987 | Header | H01R 12/725 439/607.07 |
| 6,074,225 | A * | 6/2000 | Wu | H01R 23/6873 439/101 |
| 6,685,486 | B1 * | 2/2004 | Zhang | H01R 13/6215 439/79 |
| 7,179,127 | B2 * | 2/2007 | Shiu | H01R 13/506 439/108 |
| 7,654,831 | B1 * | 2/2010 | Wu | H01R 12/62 439/607.46 |
| 7,748,999 | B1 * | 7/2010 | Sun | H01R 13/506 439/607.36 |
| 8,262,411 | B2 * | 9/2012 | Kondo | H01R 13/6658 439/607.01 |
| 8,790,138 | B2 * | 7/2014 | Wang | H01R 27/02 439/607.4 |

(Continued)

FOREIGN PATENT DOCUMENTS

| | | |
|---|---|---|
| CN | 203800319 U | 8/2014 |
| CN | 203813127 U | 9/2014 |

(Continued)

*Primary Examiner* — Neil Abrams

(74) *Attorney, Agent, or Firm* — James A. O'Malley

(57) ABSTRACT

An electrical connector comprises a housing assembly and an outer shell surrounding the housing assembly, the housing assembly comprises a first terminal module and a second terminal module; the first terminal module comprises a first body and a group of first terminals fixed to the first body, the first body has a first tongue; the second terminal module comprises a second body and a group of second terminals fixed to the second body, the second body has a second tongue; the first body and the second body oppose each other and are fixed together by at least one engagement column in the first tongue that is locked to at least one locking hole in the second tongue.

10 Claims, 6 Drawing Sheets

(56) References Cited

U.S. PATENT DOCUMENTS 8,968,031 B2 * 3/2015 Simmel ..... H01R 13/659 439/108
9,022,800 B2 * 5/2015 Yang ..... H01R 13/6581 439/487
9,178,319 B2 * 11/2015 Little ..... H01R 13/6585
9,214,767 B1 * 12/2015 Yu ..... H01R 13/6585
9,231,356 B1 * 1/2016 Ju ..... H01R 24/78
9,257,801 B2 * 2/2016 Fang ..... H01R 13/6587
9,281,629 B2 * 3/2016 Little ..... H01R 13/6583
9,281,643 B1 * 3/2016 Tseng ..... H01R 13/518
9,300,095 B2 * 3/2016 Lin ..... H01R 24/60
9,306,336 B2 * 4/2016 Chang ..... H01R 13/6471
9,318,856 B2 * 4/2016 MacDougall ..... H01R 13/6581
9,337,585 B1 * 5/2016 Yang ..... H01R 13/6583
9,337,588 B2 * 5/2016 Chang ..... H01R 13/6594
9,356,406 B2 * 5/2016 Yen ..... H01R 13/6585
9,385,482 B2 * 7/2016 Li ..... H01R 13/6585
9,437,980 B2 * 9/2016 Ueda ..... H01R 12/724
9,450,337 B2 * 9/2016 Kao ..... H01R 13/6461
9,450,339 B2 * 9/2016 Gao ..... H01R 13/6582
9,461,415 B2 * 10/2016 Guo ..... H01R 13/41
9,466,924 B2 * 10/2016 Lin ..... H01R 13/6585
9,478,923 B2 * 10/2016 Kao ..... H01R 24/60
9,490,579 B2 * 11/2016 Little ..... H01R 13/642
9,496,657 B1 * 11/2016 Chang ..... H01R 13/6471
9,496,664 B2 * 11/2016 Little ..... H01R 13/6587
9,502,821 B2 * 11/2016 Little ..... H01R 13/6582
9,502,841 B2 * 11/2016 Little ..... H01R 24/60
2014/0004744 A1 * 1/2014 Hsu ..... H01R 13/658 439/626
2015/0244111 A1 * 8/2015 Ju ..... H01R 13/6585 439/607.05
2015/0270661 A1 * 9/2015 Kao ..... H01R 13/5202 439/271
2015/0325957 A1 * 11/2015 Liao ..... H01R 43/18 439/607.05
2015/0340791 A1 * 11/2015 Kao ..... H01R 13/42 439/676
2015/0340798 A1 * 11/2015 Kao ..... H01R 13/6594 439/660
2015/0349465 A1 * 12/2015 Cornelius ..... H01R 13/665 439/620.22
2016/0020560 A1 * 1/2016 Ju ..... H01R 24/78 439/607.05
2016/0020569 A1 * 1/2016 Ju ..... H01R 24/78 439/607.01
2016/0064869 A1 * 3/2016 Yu ..... H01R 24/60 439/607.05
2016/0099523 A1 * 4/2016 Miyoshi ..... H01R 13/428 439/676
2016/0197443 A1 * 7/2016 Zhang ..... H01R 13/6585 439/607.05

FOREIGN PATENT DOCUMENTS

CN 203859275 U 10/2014
CN 104158012 A 11/2014

* cited by examiner

ELECTRICAL CONNECTOR WITH CENTRAL GROUNDING PLATE

RELATED APPLICATIONS

This application claims priority to Chinese Application No. 201520007911.7, filed Jan. 6, 2015, which is incorporated herein by reference in its entirety.

FIELD OF THE PRESENT DISCLOSURE

The present disclosure relates to an electrical connector, and more specifically relates to an electrical connector combined by a plurality of modules.

BACKGROUND OF THE PRESENT DISCLOSURE

Chinese Patent Application No. CN201420289128.X discloses an electrical connector which is suitable to connect another mating connector and comprises an engagement body, a grounding plate and an outer shell. The engagement body comprises a first terminal module and a second terminal module. The first terminal module has a first body and a plurality of first terminals. The first body has a first base portion and a first tongue portion. Each first terminal has a first mating portion and a first soldering portion. The second terminal module has a second body combined to the first body and a plurality of second terminals. The second body has a second base portion and a second tongue portion. Each second terminal has a second mating portion and a second soldering portion. The grounding plate is interposed between the first terminal module and the second terminal module. The outer shell surrounds an external space of the first tongue portion and second tongue portion, and forms a mating cavity for insertion of the mating connector. Engagement force between the two terminal modules of such an electrical connector is not high enough, and the structure strength of such an electrical connector is low, which is desirable to further improve. Thus certain individuals would appreciate an electrical connector that can provide increased engagement force between two terminal modules while providing improved structural strength of the electrical connector.

SUMMARY OF THE PRESENT DISCLOSURE

The present disclosure provides an electrical connector which comprises a housing assembly and an outer shell surrounding the housing assembly and forming a mating cavity; the housing assembly comprises a first terminal module and a second terminal module. The first terminal module can include a first body and a group of first terminals fixed to the first body. The first body can include a first main body and a first tongue extending forwardly from the first main body and the group of first terminals is exposed to a first mating surface of the first tongue. The second terminal module comprises a second body and a group of second terminals fixed to the second body. The second body has a second main body and a second tongue extending forwardly from the second main body and the group of second terminals are exposed to a second mating surface of the second tongue. The housing assembly can further include a grounding plate provided between the group of first terminals and the group of second terminals. The first body and the second body oppose each other and are fixed together. In an embodiment the first tongue is provided with at least one engagement column protruding from the first tongue toward the second tongue and the second tongue is provided with at least one locking hole passing through along a thickness direction of the second tongue. The at least one engagement column can correspondingly be inserted into the at least one locking hole and then can be stamped so that the first tongue and the second tongue are firmly engaged together.

DETAILED DESCRIPTION

Figure 1:
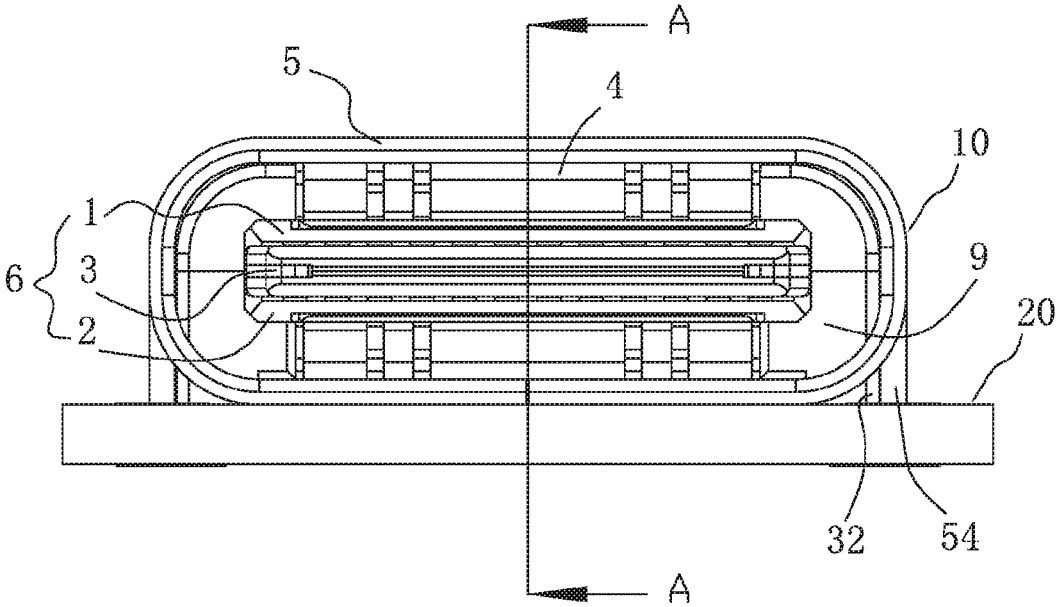
FIG. 1 is a front view of an electrical connector in an embodiment of the present disclosure and a circuit board.

While the depicted embodiments may be susceptible to embodiment in different forms, there is shown in the Figures, and will be described herein in detail, specific embodiments, with the understanding that the present disclosure is to be considered an exemplification of certain principles and is not intended to limit the Present Disclosure to that which is illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted. As can be appreciated, the depicted electrical connector has an engagement column is formed on a first tongue of a first terminal module and a locking hole is correspondingly formed on a second tongue of a second terminal module when the engagement column is inserted into the locking hole and stamped the engagement column is firmly fixed into the locking hole so as to provide higher engagement force between the two terminal modules and improve the structure strength of the electrical connector.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Hereinafter, an embodiment of the present disclosure will be described in detail in combination with Figures.

Referring to FIG. 1 to FIG. 8, an electrical connector in an embodiment of the present disclosure is illustrated. Specifically, the electrical connector in the embodiment is a receptacle connector. The electrical connector 10 comprises a first terminal module 1, a second terminal module 2, a grounding plate 3 which can be formed of metal, an inner shell 4 and an outer shell 5. The first terminal module 1, the second terminal module 2 and the grounding plate 3 are combined into a housing assembly 6. The inner shell 4 is mounted to an outer periphery of the housing assembly 6. The outer shell 5 surrounds an outer periphery of the housing assembly 6 and the inner shell 4 and correspondingly forms a mating cavity 9 opened forwardly for insertion of a mating electrical plug connector (not shown). The electrical connector 10 may be mounted on a circuit board 20.

Figure 6:
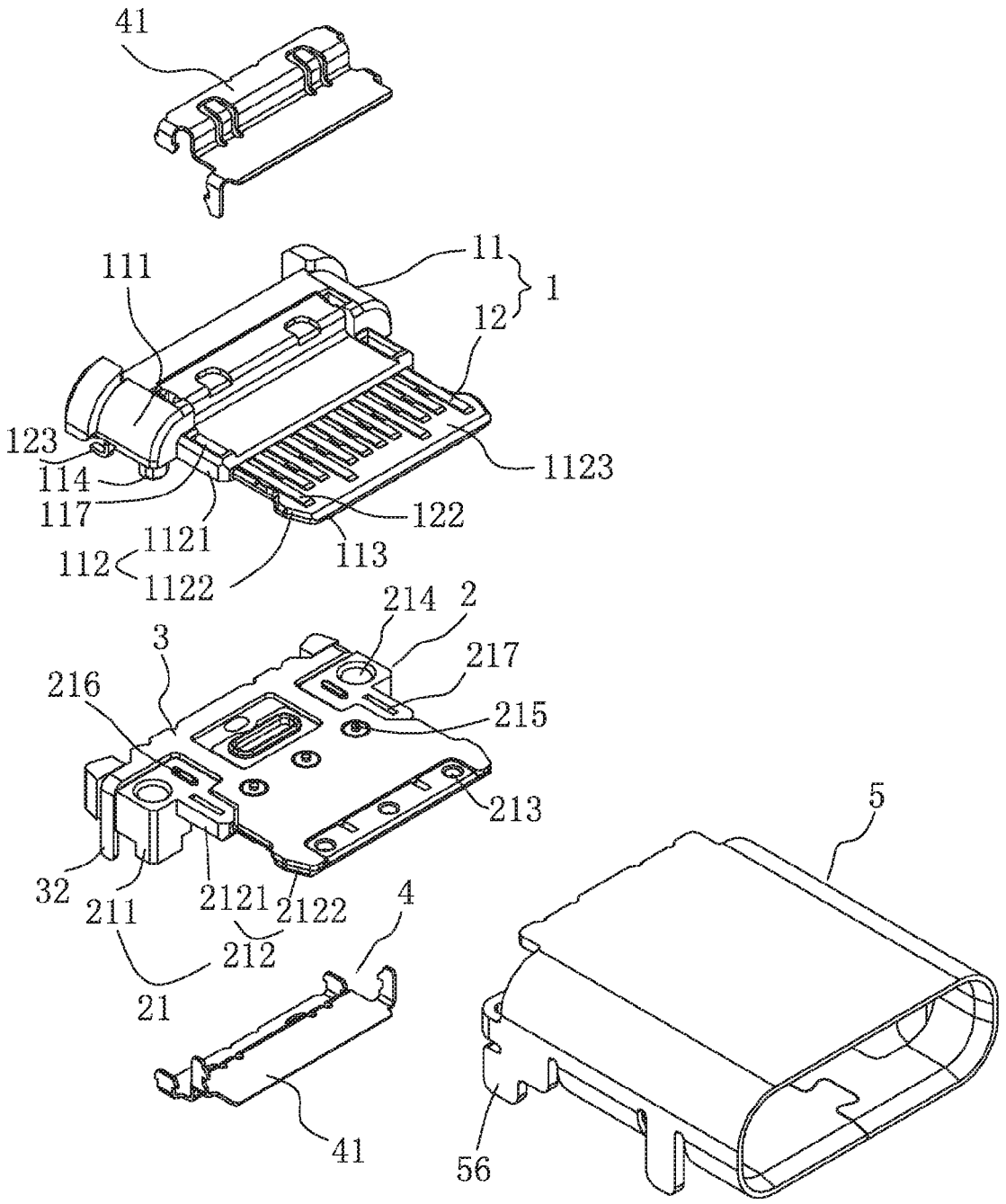
FIG. 6 is an exploded perspective view of the embodiment depicted in FIG. 5.
Figure 7:
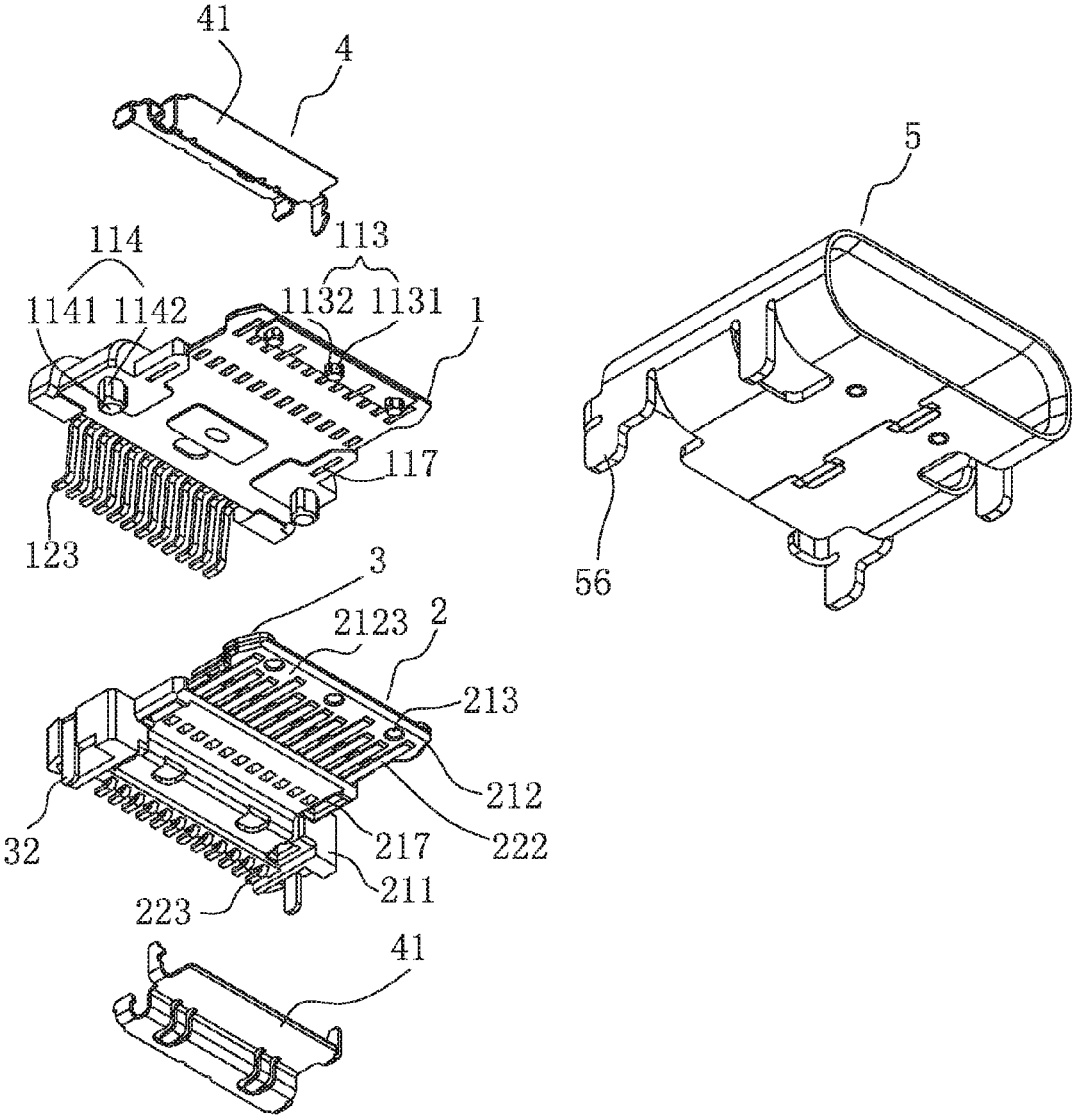
FIG. 7 is another exploded perspective view of the embodiment depicted in FIG. 5, taken from a different angle.
Figure 8:
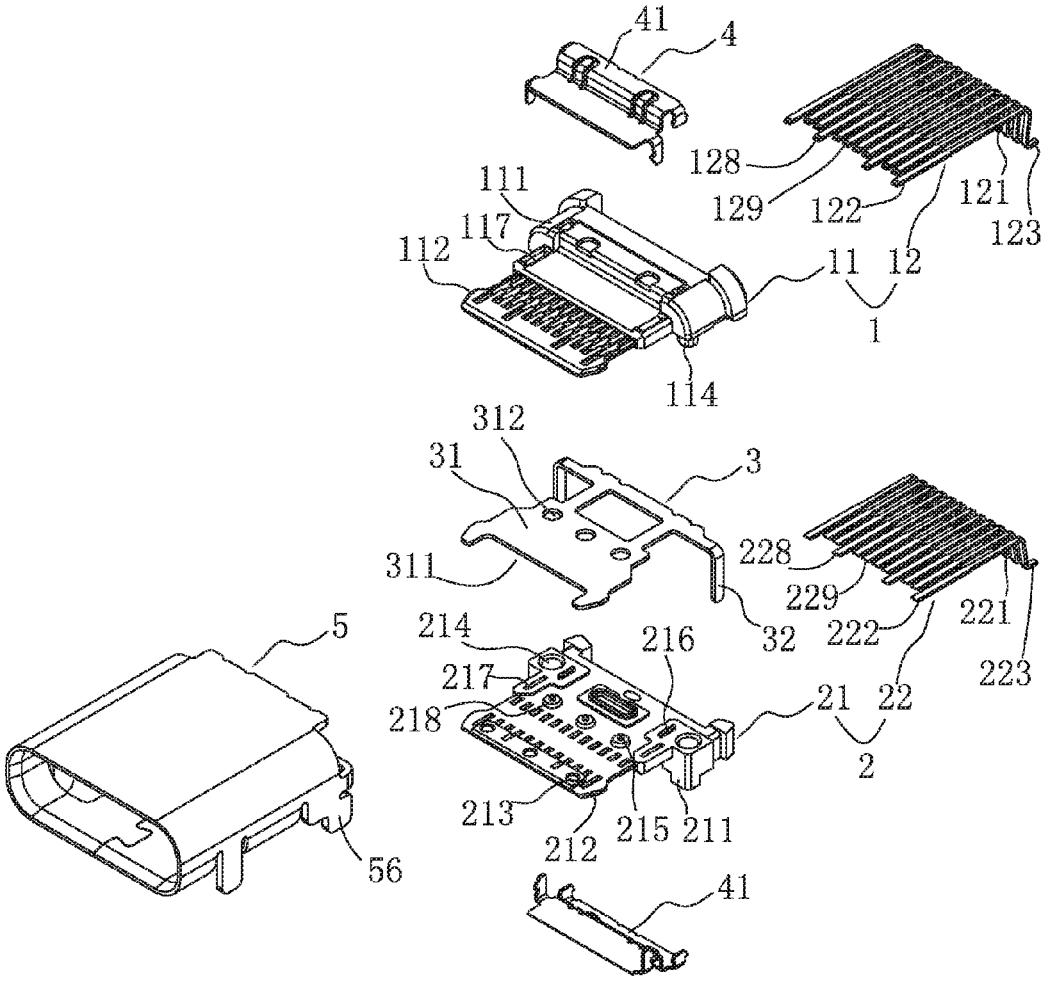
FIG. 8 is a further exploded perspective view of the embodiment depicted in FIG. 6.

Referring to FIG. 6, FIG. 7 and FIG. 8, the first terminal module 1 comprises a first body 11 and a group of first terminals 12 fixed to the first body 11 with insert molding process. The first terminals 12 are conductive and the first body 11 is insulative. The first body 11 has a first main body 111 and a first tongue 112 extending forwardly from the first main body 111. The first tongue 112 has a base plate 1121, which is relatively thick, and an extension plate 1122 which extends forwardly from the base plate 1121 and is relatively thin. The depicted first tongue 112 is provided with three engagement columns 113 positioned close to a front edge of the extension plate 1122 and protruding downwardly. Each engagement column 113 comprises a body portion 1131 which is cylindrical in shape and a plurality of protruding ribs 1132 protruding from an outer periphery of the body portion 1131. The first body 11 is also provided with two insertion columns 114 protruding downwardly at the first main body 111. Each insertion column 114 comprises a body portion 1141 which is cylindrical in shape and a plurality of protruding ribs 1142 protruding from an outer periphery of the body portion 1141. In comparison, the engagement column 113 is substantially smaller than the insertion column 114. The first tongue 112 is provided with a first fixing hole 117, which vertically passes through the first tongue 112 and is closed in periphery, at each of two sides of the base plate 1121.

Each first terminal 12 has a fixed portion 121 embedded in the first main body 111, a mating portion 122 extending forwardly from the fixed portion 121 and exposed to a first mating surface 1123 of the first tongue 112, and a soldering portion 123 bent rearwardly from the fixed portion 121 and extending through a rear end of the first main body 111. These first terminals 12 are divided into a plurality of anterior position first terminals 128 in which the mating portion 122 is close to the front end of the first tongue 112 and a plurality of posterior position first terminals 129 in which the mating portion 122 is behind the mating portion 122 the anterior position first terminals 128 according to arrangement of these first terminals 12 on the first tongue 112. The three engagement columns 113 are correspondingly positioned in front of these posterior position first terminals 129 and correspondingly positioned between these anterior position first terminals 128.

Similarly, the second terminal module 2 comprises a second body 21 and a group of second terminals 22 fixed to the second body 21 with insert molding process. The second body 21 is insulative and the group of second terminals 22 is conductive. The second body 21 has a second main body 211 and a second tongue 212 extending forwardly from the second main body 211. The second tongue 112 has a base plate 2121 which is thick and an extension plate 2122 which extends forwardly from the base plate 2121 and is thin. The second tongue 212 is provided with three locking holes 213 close to a front edge of the extension plate 2122 the second tongue 212 along a thickness direction of the second tongue 212. The second main body 211 is provided with two positioning holes 214 respectively engaged with the two insertion columns 114. In the embodiment, these protruding ribs 1132 on the engagement column 113 are tightly engaged with the locking hole 213, which may function as preliminary fixation before stamping the engagement column 113 and may be beneficial to perform subsequent stamping process. These insertion columns 114 each are inserted into one of these positioning holes 214 in form of interference fit, which is beneficial to strengthen the engagement strength between the first main body 111 and the second main body 211. The second tongue 212 is formed with a second fixing hole 217, which vertically passes through the second tongue 212 and is closed in periphery, at each of two sides of the base plate 2121. After these engagement columns 113 are respectively inserted into and pass through these locking holes 213, these engagement columns 113 are stamped so that these engagement columns 113 are respectively fixed in these locking holes 213 and cannot respectively be reversely removed out of these locking holes 213. Such an engagement and fixation structure may allow the first tongue 112 and the second tongue 212 to be firmly engaged together.

In addition, the base plate 2121 of the second tongue 212 is formed with three dot-like protrusions 215 on a surface opposing the first tongue 112. The second main body 211 is formed with two bar-like protrusions 216 on a surface opposing the first main body 111. The base plate 2121 of the second tongue 212 is formed with three positioning columns 218 protruding from the surface opposing the first tongue 112, these dot-like protrusions 215 respectively protrude from top ends of these positioning columns 218. Specifically, the positioning column 218 has a shape which is small in the upper and large in the lower so as to form a cylinder step. The first body 11 and the second body 21 may be engaged and fixed together at these protrusions 215, 216 with ultrasonic welding, which may strengthen the engagement strength between the first body 11 and the second body 21 at the middle and rear part of the first body 11 and second body 21.

Each second terminal 22 has a fixed portion 221 embedded in the second main body 211, a mating portion 222 extending forwardly from the fixed portion 221 and exposed to a second mating surface 2123 of the second tongue 212 and a soldering portion 223 bent rearwardly from the fixed portion 221 and extending through a rear end of the second main body 211. These second terminals 22 are divided into a plurality of anterior position second terminals 228 and a plurality of posterior position second terminals 229 according to arrangement of these second terminals 22 on the second tongue 212. The three locking holes 213 are correspondingly positioned in front of these posterior position second terminals 229 and are correspondingly positioned between these anterior position second terminals 228. The arrangement of the three locking holes 213 does not bring negative effect on the arrangement of the second terminals 22 and is beneficial to sufficiently use the limited space on the second tongue 212.

It should be noted that, after these engagement columns 113 are respectively inserted into and pass through these locking holes 213, these engagement columns 113 are preferably slightly protrude from the second mating surface 2123 of the second tongue 212 before stamping, and do not protrude from the second mating surface 2123 of the second tongue 212 after stamping, so as to minimize interference with insertion of the mating electrical plug connector. The locking hole 213 is preferably formed with an expanded portion 2132, the opening of which is gradually enlarged, at a side end of the locking hole 213 close to the second mating surface 2123 (see FIG. 2), the end of the engagement column 113 can be formed with a locking flange (not shown) locked in the expanded portion 2132 after stamping, so that the engagement column 113 cannot be reversely removed out of the locking hole 213. Such an engagement structure between the engagement column 113 and the locking hole 213 may strengthen the engagement strength between the extension plate 1122 of the first tongue 112 and the extension plate 2122 of the second tongue 212. The engagement strength is strengthened at the front part of the first body 11 and the second body 21 and this increased strength can help prevent the first tongue 112 and the second tongue 212 from cracking due to impact from a mating electrical plug connector.

Figure 4:
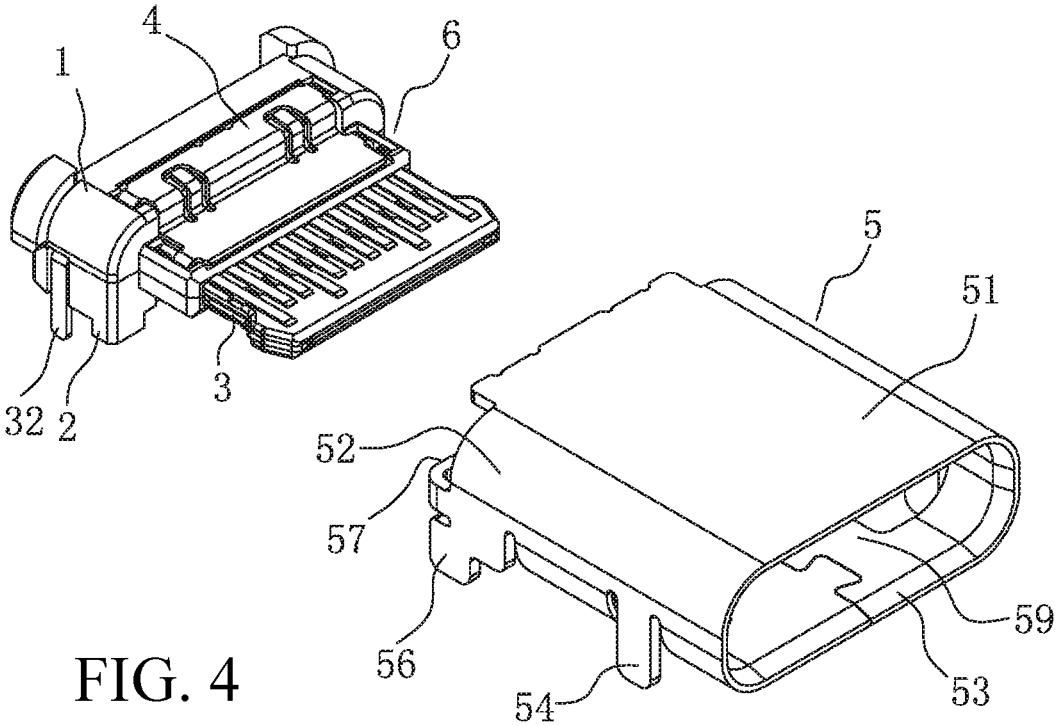
FIG. 4 is an exploded perspective view of an embodiment of an electrical connector.
Figure 5:
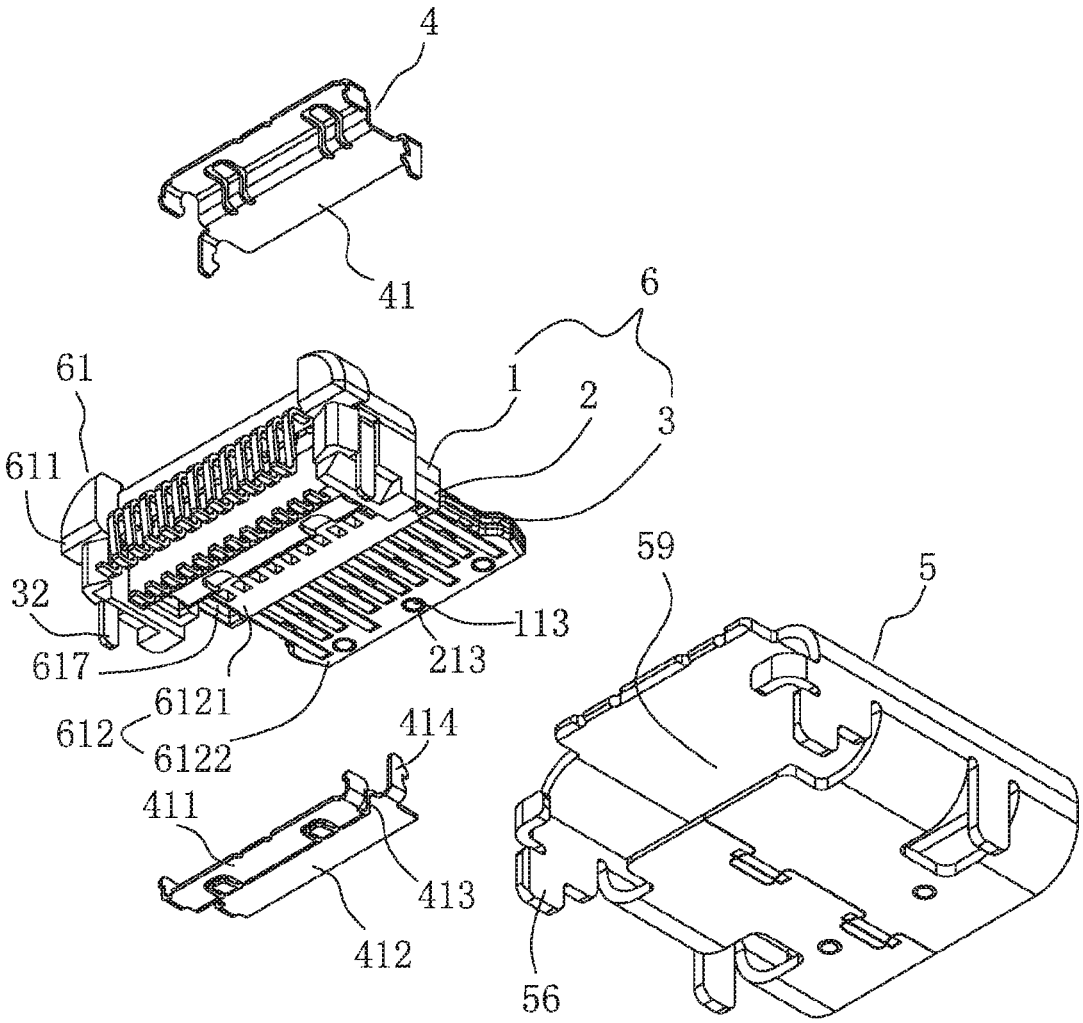
FIG. 5 is a further exploded perspective view of the embodiment depicted in FIG. 4.

Referring to FIG. 4 and FIG. 5, in the housing assembly 6, the first body 11 and the second body 21 provide a combined insulative body 61 due to opposing and engagement with each other. The first main body 111 and the second main body 211 together define a base portion 611 of the combined insulative body 61. The first tongue 112 and the second tongue 212 together define a tongue 612 of the combined insulative body 61. The tongue 612 has a base plate 6121 which is defined by the base plate 1121 of the first tongue 112 and the base plate 2121 of the second tongue 212 and an extension plate 6122 which is defined by the extension plate 1122 of the first tongue 112 and the extension plate 2122 of the second tongue 212. The first fixing hole 117 and the second fixing hole 717 together define a fixing hole 617 of the combined insulative body 61.

Referring to FIG. 1, the mating portions 122 of the group of first terminals 12 and the mating portions 222 of the group of second terminals 22 are provided on the tongue 612 and in the mating cavity as 180 degree rotational symmetry, so that the purpose of proper insertion may be attained regardless that the mating electrical plug connector is inserted into the electrical connector 10 in a first direction or a second direction reversed with respect the first direction.

Figure 2:
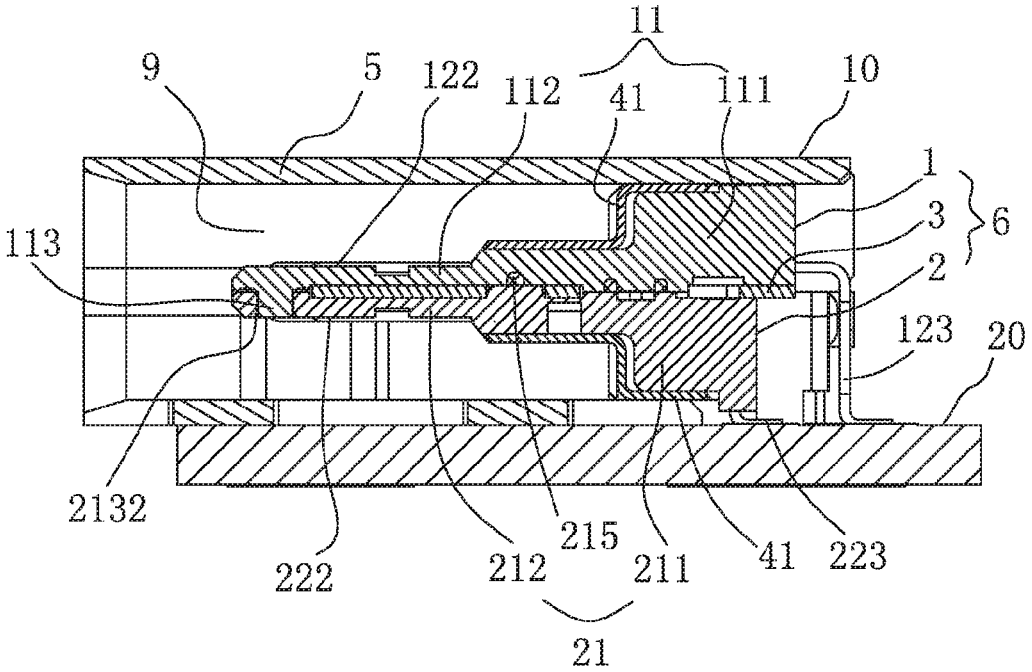
FIG. 2 is a cross sectional view taken along a line A-A of FIG. 1.
Figure 3:
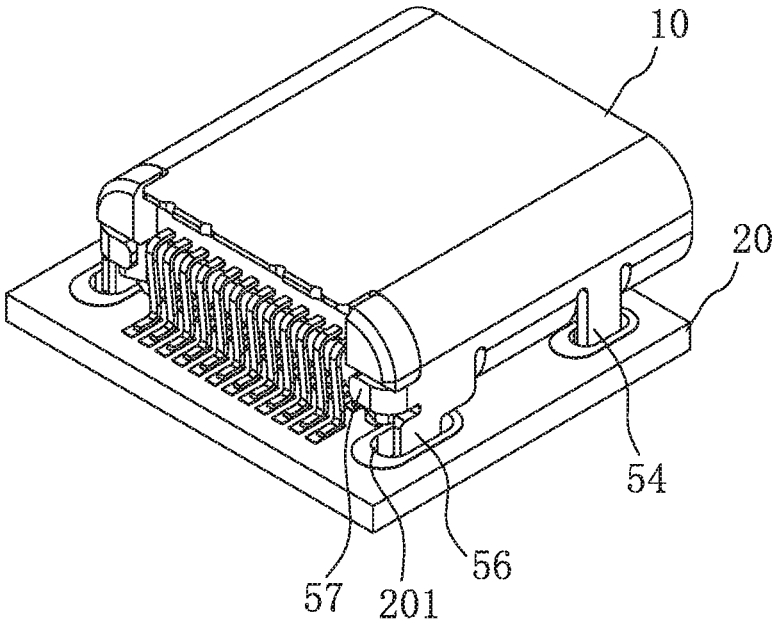
FIG. 3 is a perspective view of the electrical connector in the embodiment of the present disclosure and the circuit board.

Referring to FIG. 7 and FIG. 8, the grounding plate 3 includes a base plate 31 and two grounding legs 32 bent from a rear end of the base plate 31 toward two sides of the base plate 31 and extending out of the combined insulative body 61. Referring to FIGS. 1-3, the two grounding legs 32 may be respectively inserted into and soldered into soldering holes 201 of the circuit board 20. The base plate 31 of the grounding plate 3 is interposed between the group of first terminals 12 and the group of second terminals 22. The base plate 31 is formed with a receiving void 311 opening forwardly at a position corresponding to these engagement columns 113. The base plate 31 is formed with a receiving channel 312 at a position corresponding to these positioning columns 218. In the embodiment, the receiving channel 312 comprises three circular holes respectively cooperating with the three positioning columns 218, in the manner that the circular hole cooperates with the positioning column 218 having the cylinder step, the position of the grounding plate 3 may be assured, so that it is beneficial to accurately position the grounding plate 3 relative to the second body 21.

It should be noted that, the grounding plate 3 may be one separate member and may be interposed between the first terminal module 1 and the second terminal module 2 as that in the present embodiment. However, in some possible embodiments, the grounding plate 3 may also be engaged and integral with one of the first terminal module 1 and the second terminal module 2 (not shown). For example, the grounding plate 3 is embedded in the first body 11. Still for example, the grounding plate 3 is embedded in the second body 21. The use of grounding plate 3 can both strengthen the tongue 612 and may also be beneficial for signal integrity by allowing the electrical connector 10 to have better Electro Magnetic Compatibility (EMC) performance Electro Magnetic Compatibility.

Referring to FIG. 4 and FIG. 5, the inner shell 4 has a step shape which is fixed to the base portion 611 of the combined insulative body 61 and extends a certain distance toward the tongue 612. Specifically, the inner shell 4 is defined by two shielding plates 41 respectively mounted to an upper side and a lower side of the combined insulative body 61. Each shielding plate 41 comprises a horizontal fixed portion 411 covering the base portion 611, a horizontal extension portion 412 covering the tongue 612 and a vertical connection portion 413 connected between the horizontal extension portion 412 and the horizontal fixed portion 411. Two fixed tabs 414 are vertically bent respectively from two sides of the horizontal extension portion 412 and extend, and the two fixed tabs 414 respectively snap into the two fixing holes 617 respectively at two sides of the base plate 6121 of the tongue 612. Because the two fixing holes 617 vertically pass through and are closed in periphery, it may allow the inner shell 4 to be fixed on the tongue 612 more firmly. The inner shell 4 may be in contact with a grounding tab of the mating electrical plug connector, which is beneficial to promote the EMC performance of the electrical connector 10.

Referring to FIG. 4 and FIG. 5, the outer shell 5 comprises a top wall 51, two side walls 52 respectively bent downwardly from two sides of the top wall 51 and extending, a bottom wall 53 formed by allowing two lower ends of the two side walls 52 to be bent oppositely, extend oppositely and be engaged with each other, two front grounding legs 54 respectively extending downwardly from the two side walls 52, two rear grounding legs 56 respectively extending downwardly from the two side walls 52 and two latching arms 57 respectively bent rearwardly from the two side walls 52 and extending. The top wall 51, the two side walls 52 and the bottom wall 53 define a cavity 59 passing through along a front-rear direction. One front grounding leg 54 and one rear grounding leg 56 are aligned with each other along the front-rear direction to form a row. Referring to FIG. 1 and FIG. 3 at the same time, it should be noted that the rear grounding leg 56 (the position of the rear grounding leg 56 along the transversal direction is identical to the position of the front grounding leg 54 indicated in FIG. 1) and the grounding leg 32 of the grounding plate 3 are abutted against each other and arranged side by side, both of the rear grounding leg 56 and the grounding leg 32 may be inserted into the same soldering hole 201 of the circuit board 20. In the embodiment, the grounding leg 32 is abutted against an inner side of the rear grounding leg 56; however, in other embodiments, the grounding leg 32 may extend outwardly out of the outer shell 5 and is abutted against an outer side of the rear grounding leg 56 (not shown). In addition, the outer shell 5 and the inner shell 4 are preferably in tight contact with each other, for example, the outer shell 5 and the inner shell 4 are engaged and fixed together at some locations with laser welding. In this way the overall structure strength of the electrical connector 10 can be increase while also improving the grounding performance of the inner shell 4.

An assembly process of the electrical connector 10 of the present disclosure generally comprises: molding the first body 11 by injecting molten plastic onto the group of first terminals 12 so as to form the first terminal module 1; molding the second body 21 by injecting molten plastic onto the group of second terminals 22 so as to form the second terminal module 2; interposing the grounding plate 3 between the first terminal module 1 and the second terminal module 2; then, melting the protrusions 215, 216 with ultrasonic welding and stamping the engagement columns 113 respectively inserted into the locking holes 213, so as to allow the first terminal module 1, the second terminal module 2 and the grounding plate 3 to be engaged and fixed together and in turn obtain the housing assembly 6; next, mounting and fixing the two shielding plates 41 respectively to the upper side and the lower side of the housing assembly 6; then, inserting the housing assembly 6 mounted with the inner shell 4 into the cavity 59 of the outer shell 5 from the rear to the front; finally, bending the latching arms 57 at the rear end of the outer shell 5 so as to lock the housing assembly 6 in the cavity 59.

As can be appreciated, the engagement column 113 is formed on the first tongue 112 of the first terminal module 1, the locking hole 213 is correspondingly formed on the second tongue 212 of the second terminal module 2, and in when the engagement column 113 inserted into the locking hole 213 and stamped so as to form a locking flange. The stamped engagement column 113 thus becomes firmly fixed into the locking hole 213; in addition, the plurality of protrusions 215, 216 can be connected with ultrasonic welding so as to allow the first terminal module 1 and the second terminal module 2 to be firmly engaged together. Thus the structure strength of the electrical connector 10 is effectively strengthened so as to prevent the first terminal module 1 and the second terminal module 2 from cracking.

What have been described above are only embodiments of the present disclosure, the implementing solution of the present disclosure is not limited to that, that is, person skilled in the art may conveniently make variations and modifications according to the main concept and spirit of the present disclosure, therefore the extent of protection of the present disclosure shall be determined by terms of the Claims.

What is claimed is:

1. An electrical connector, comprising;

a housing assembly;

an outer shell surrounding the housing assembly and forming a mating cavity, wherein the housing assembly comprises a first terminal module and a second terminal module, the first terminal module comprising a first body and a group of first terminals fixed to the first body, the first body having a first main body and a first tongue extending forwardly from the first main body, the group of first terminals being exposed to a first mating surface of the first tongue;

the second terminal module comprising a second body and a group of second terminals fixed to the second body, the second body having a second main body and a second tongue extending forwardly from the second main body, the group of second terminals being exposed to a second mating surface of the second tongue;

a grounding plate supported by the first body and the second body and positioned between the group of first terminals and the group of second terminals, wherein the first body and the second body oppose each other and are fixed together and the first tongue is provided with at least one engagement column protruding from the first tongue toward the second tongue and the second tongue being provided with at least one locking hole passing through along a thickness direction of the second tongue, wherein the at least one engagement column is positioned in the at least one locking hole and is stamped so that the first tongue and the second tongue are engaged together.

2. The electrical connector according to claim 1, wherein the at least one engagement column is provided at a position close to a front end of the first tongue, the grounding plate is formed with a receiving void at a position corresponding to the at least one engagement column.

3. The electrical connector according to claim 1, wherein after the at least one engagement column is positioned in the at least one locking hole.

4. The electrical connector according to claim 3, wherein the locking hole is formed with an expanded portion at a side end close to the second mating surface, the expanded portion is used to receive a locking flange formed by an end of the engagement column.

5. The electrical connector according to claim 4, wherein these second terminals are divided into a plurality of anterior position second terminals and a plurality of posterior position second terminals according to arrangement of these second terminals on the second tongue and the locking holes are positioned in front of these posterior position second terminals and positioned between these anterior position second terminals.

6. The electrical connector according to claims 4, wherein each engagement column comprises a body portion which is cylindrical and a plurality of protruding ribs protruding from an outer periphery of the body portion, these protruding ribs and the locking hole are tightly engaged with each other.

7. The electrical connector according to claim 1, wherein the second body is formed with a plurality of positioning columns protruding from an engagement surface opposing the first body and the grounding plate is formed with a receiving channel at a position corresponding to these positioning columns, these positioning columns pass through the receiving channel so as to assure a position of the grounding plate, these positioning columns respectively are further formed with a plurality of dot-like protrusions at top ends of these positioning columns for engaging with the first body with ultrasonic welding.

8. The electrical connector according to claim 1, wherein each side of the outer shell is formed with a first grounding leg extending downwardly therefrom, each side of the grounding plate is formed with a second grounding leg extending downwardly therefrom, two second grounding legs respectively abut against two inner sides of two first grounding legs.

9. The electrical connector according to claim 1, wherein the first main body is further provided with at least one insertion column protruding toward the second main body, the insertion column comprises a body portion and at least one protruding rib protruding from an outer periphery of the body portion and the second main body is correspondingly provided with at least one positioning hole, the at least one insertion column is inserted into the at least one positioning hole.

10. The electrical connector according to claim 1, wherein the grounding plate is a separate member interposed between the first terminal module and the second terminal module, the grounding plate comprises a base plate positioned between the first tongue and the second tongue and at least one grounding leg bent outwardly from the base plate.

* * * * *